US005123887A

United States Patent [19]

Shimura

[11] Patent Number: 5,123,887

[45] Date of Patent: Jun. 23, 1992

[54] APPARATUS FOR DETERMINING PROCESSING POSITIONS OF PRINTER SLOTTER

[75] Inventor: Naoki Shimura, Kasugai, Japan

[73] Assignee: Isowa Industry Co., Ltd., Aichi, Japan

[21] Appl. No.: 641,258

[22] Filed: Jan. 15, 1991

[30] Foreign Application Priority Data

Jan. 25, 1990 [JP] Japan ..... 2-5737[U]

[51] Int. Cl.[5] ..... B65K 3/24

[52] U.S. Cl. ..... 493/34; 493/30; 493/324; 271/142

[58] Field of Search ..... 493/13–15, 493/18, 21, 28, 30, 34, 35, 36, 324, 355, 362, 120, 122; 271/3–4, 131, 133, 142, 143, 144

[56] References Cited

U.S. PATENT DOCUMENTS

| | | | |
|---|---|---|---|
| 4,514,819 | 4/1985 | Punater et al. | 493/35 X |
| 4,527,788 | 7/1985 | Masuda | 493/324 X |
| 4,604,083 | 8/1986 | Barny et al. | 493/28 X |
| 4,968,292 | 11/1990 | Takeda | 493/324 X |

FOREIGN PATENT DOCUMENTS

| | | | |
|---|---|---|---|
| 0133830 | 5/1989 | Japan | 271/131 |

*Primary Examiner*—Bruce M. Kisliuk
*Assistant Examiner*—John Marlott
*Attorney, Agent, or Firm*—Cushman, Darby & Cushman

[57] ABSTRACT

An apparauts for placing a printer-slotter in positions where it processes sheets of corrugated paper. The printer-slotter includes a feeding unit for feeding the sheets, processing units, and differentials connected with the processing units. The apparatus comprises a position detector for detecting the position of the kicker of the feeding unit, positioning controllers connected with a central control unit (CCU), and sensors detecting the angular positions of the rotating cylinders included in the printing units and in the creaser-and-slotter unit. The sensors are connected with the positioning controllers, respectively. The CCU compares the position of the kicker with the positions at which the processing units process the sheets. The CCU controls the differentials in such a way that the position of the kicker corresponds to the positions at which the processing units process the sheets.

4 Claims, 1 Drawing Sheet

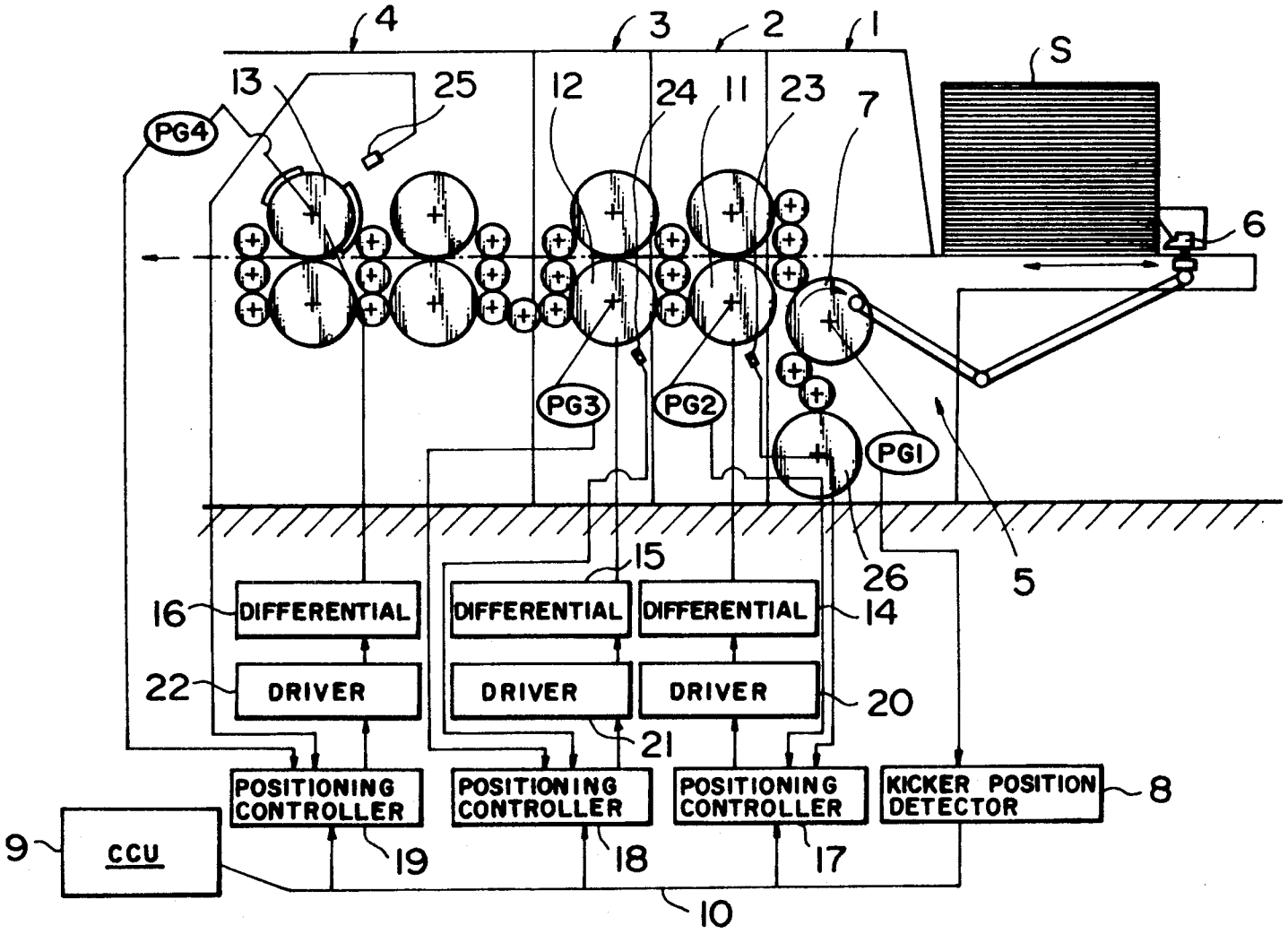
S
6
5
1
2
3
4
7
23
11
24
12
25
13
PG1
PG2
PG3
PG4
26
14
15
16
20
21
22
DIFFERENTIAL
DIFFERENTIAL
DIFFERENTIAL
DRIVER
DRIVER
DRIVER
POSITIONING CONTROLLER
POSITIONING CONTROLLER
POSITIONING CONTROLLER
17
18
19
KICKER POSITION DETECTOR
8
10
CCU
9

APPARATUS FOR DETERMINING PROCESSING POSITIONS OF PRINTER SLOTTER

FIELD OF THE INVENTION

The present invention relates to an apparatus for determining the positions at which a printer-slotter processes corrugated paper and, more particularly, to an apparatus for placing such processing positions of the units of the printer-slotter in phase.

BACKGROUND OF THE INVENTION

Generally, a printer-slotter of this kind comprises various units which are separably connected according to the processing conditions. These units include a feeding unit having a kicker for kicking stacked sheets of corrugated paper successively from the lowermost sheet, a plurality of printing units for printing on the sheets sent from the feeding unit, a creaser-and-slotter unit for forming creasing lines or slots at desired locations on the sheets sent from the printing units, and a palletizer for gathering the processed sheets. When each unit is connected, adjacent units are successively coupled together with gears. Under this condition, the coupled units can be driven by a drive mechanism included in the feeding unit. The kicker of the feeding unit is reciprocated by the drive mechanism via a crank mechanism to kick the sheets of corrugated paper lying on a table. The printer-slotter takes the point at which the kicker of the feeding unit kicks as its home position. With respect to other units, an origin forming the reference of processing is set on rotating cylinders on which press plates or processing blades are installed. When the printer-slotter is operated, the various units are placed in phase so that they can process sheets at given positions.

When preparations for a work or an inspection is made, the units described above are disconnected from each other. Then, the rotating cylinders are separately rotated to make a setting. Therefore, if the various units are simply coupled together, the home positions of the units do not agree, i.e., they are out of phase and arranged randomly. Under this condition, the machine cannot be run. In the past, therefore, the kicker of the feeding unit is first placed in its home position in which the kicker normally kicks after the various units are coupled together. Then, differentials mounted in the units are separately driven by servomotors, as described in Japanese Patent Laid-Open No. 32664/1985 filed by the present applicant. The home positions of the rotating cylinders for their respective units are detected by sensors, and the units are returned to their home positions. After the units are placed in phase in this way, the machine is run ordinarily.

The above-described method of determining the positions at which paper is processed has the following disadvantages. After the feeding unit is returned to its home position, the rotating cylinders for the units are returned to their home positions. In this way, two stages of adjustment are necessitated. In addition, it is not easy to correctly return the kicker to its home position. In particular, various units such as printing units are successively connected to the feeding unit. In this state, the kicker is returned to its home position. Therefore, the moments of inertia of other units are added to the moment of inertia of the driving mechanism of the feeding unit. As a result, the moment of inertia of the whole system is quite large. If the home position sensor detects the home position of the kicker, and if the motor of the drive mechanism is stopped from operating, the drive mechanism keeps rotating because of its large moment of inertia. The kicker will come to a stop after passing beyond its home position. Hence, it is not easy to accurately place the kicker in position. Secondly, the motor incorporated in the drive mechanism of the feeding unit has a large capacity so that it can drive other units connected in tandem to the feeding unit. For this reason, the motor is unsuited for fine adjustment of position. This also makes it difficult to accurately return the kicker to its home position. When the kicker shifts out of its home position, the produced error appears as the error of the whole printer-slotter even if the rotating cylinders for the units other than the feeding unit which are next adjusting means are accurately placed in their home positions. The result is that an error arises in processing sheets of corrugated paper.

SUMMARY OF THE INVENTION

It is an object of the invention to provide an apparatus which determines the processing positions of a printer-slotter in such way that various units are quickly and easily placed in position with improved accuracy, as well as the kicker of a feeding unit.

The above object is achieved by a printer-slotter which comprises: differentials capable of adjusting the processing positions of processing units independently, the processing units being separably connected in tandem to a feeding unit; and a position detector for detecting the position at which the feeding unit kicks. When the order in which the units are arranged is changed, press plates, processing blades, and other parts are set on the processing units. Then, the processing units are connected in tandem to the feeding unit. In this state, the kicker and the processing units assume arbitrary positions in processing sheets of corrugated paper. First, the position detector detects the position of the kicker. The output signal from the detector is sent to a central control unit (CCU), which then controls the operation of the differentials of the processing units according to the signal in such a way that the processing positions of the processing units and the position of the kicker are placed in phase and that the machine can be operated normally.

Other objects and features of the invention will appear in the course of the description thereof which follows.

BRIEF DESCRIPTION OF THE DRAWING

The FIGURE is a schematic diagram of an apparatus that is built in accordance with the invention and determines the positions at which a printer-slotter processes sheets of paper.

DETAILED DESCRIPTION OF THE INVENTION

Referring to the figure, there is shown an apparatus for determining the positions at which a printer-slotter processes sheets of paper, the apparatus being fabricated in accordance with the invention. The apparatus comprises a feeding unit 1, a first printing unit 2, a second printing unit 3, and a creaser-and-slotter unit 4. The printing units 2 and 3 are replaced with other printing units according to the kind of printing. Also, the number of printing units can be increased and decreased according to the kind of printing. In the creaser-and-slotter unit 4, the processing blade can be arbitrarily replaced with any other blade. The creaser-and-slotter unit 4 can be replaced with other processing unit. Furthermore, other processing unit can be separably connected to the unit 4. When these units 2–4 are connected successively, they are coupled to the drive mechanism 5 of the feeding unit 1 via gears successively and driven by the drive mechanism 5 in the same way as in the prior art apparatus.

The drive mechanism 5 of the feeding unit 1 is equipped with a driving motor 26 for reciprocating a kicker 6. The drive mechanism 5 has a first pulse generator PG1 for detecting the position of the kicker 6 immediately prior to the initiation of operation. This generator PG1 may be installed on any rotating portion of the drive mechanism 5 as long as it rotates in response to the reciprocation of the kicker 6. In the illustrated example, the pulse generator is mounted on the rotating shaft of a crank wheel 7. The feeding unit 1 is not equipped with a home position returning mechanism for returning the kicker 6 to its home position that is normally taken as the point at which kick is started. The first pulse generator PG1 is connected with a kicker position detector 8 which receives and counts the output pulses from the pulse generator PG1. The detector 8 locates the present position of the kicker from the home position of the kicker 6 and informs the CCU 9 of the present position of the kicker 6 via a data bus 10.

The first printing unit 2, the second printing unit 3, and the creaser-and-slotter unit 4 are equipped with differentials 14, 15, 16, respectively, which rotate their respective cylinders 11, 12, 13 independently. The harmonic drive mechanism described in Japanese Patent Laid-Open No. 32664/1985 can be preferably used as the differentials 14–16. Differentials of other known structure can also be used. The differentials 14–16 are driven by driver circuits 20–22, respectively, under the control of positioning controllers 17–19, respectively. Print plates or processing blades are installed in their home positions for the rotating cylinders 11–13. When the differentials 11–13 are driven, their angular positions, or angular displacements from these home positions, are detected by second, third, and fourth pulse generators PG2, PG3, PG4, respectively. The upper dead points of the cylinders 11–13 are set, corresponding to the home position of the kicker 6. The home positions of the cylinders 11–13 are detected by sensors 23–25, respectively. The driver circuits 20–22, the second through fourth pulse generators PG2–PG4, and the sensors 23–25 are connected with the position controllers 17–19, respectively. These controllers 17–19 receive the output signals from the sensors 23–25, respectively, and control the operation of the driver circuits 20–22, respectively, under the control of the CCU 9. The CCU 9 consists of a computer and provides a numerical control of the driver circuits via the positioning controllers 17–19.

In each of the first printing unit 2 and the second printing unit 3, the rotating cylinders 11 or 12 comprise a plate cylinder on which a print plate is installed and an impression cylinder forming a pair with the plate cylinder. The impression cylinder applies pressure. In the creaser-and-slotter unit 4, the rotating cylinders 13 comprise a cylinder and an anvil roll against which a processing blade bears, the blade being mounted on the cylinder. The cylinders on which the print plates or processing blades are installed are rotated by the differentials 14–16 to place them in position.

The operation of the apparatus for determining the processing positions of the printer-slotter is next described. When a machining process corresponding to the previous orders is finished, the various units are separated to process sheets of paper on the next instructions. The system is set up according to the processing conditions. For instance, the print plates are replaced with other print plates. The positions of processing blades are adjusted laterally, i.e., perpendicularly to the direction in which the sheets S of corrugated paper are conveyed. Then, the units are connected successively. When the units are simply connected, the kicker 6 is at rest at an arbitrary position which was assumed when the processing corresponding to the previous orders ended and the operation of the system stopped.

The first pulse generator PG1 delivers output pulses corresponding to the distance traveled by the kicker 6 to the kicker position detector 8. The detector 8 calculates the distance from the home position at which a kick was started, from the incoming pulses. The detector 8 informs the CCU 9 of the aforementioned arbitrary position at which the kicker 6 is at rest immediately prior to the start of the operation of the system via the data bus When the kicker 6 is in its home position and the home positions of the rotating cylinders 11–13 are detected by the sensors 23–25, i.e., when the cylinders are placed in phase, the first printing unit 2, the second printing unit 3, and the creaser-and-slotter unit 4 can print, form slots, or perform other processing at given positions on the sheets S of corrugated paper. For this purpose, the angular displacements of the rotating cylinders 11–13 from their home positions are detected by the use of the second through fourth pulse generators PG2–PG4, the home positions being detected by the sensors 23–25, respectively. To detect these angular displacements of the cylinders 11–13 from their home positions, the driver circuits 20–22 are controlled by the positioning controllers 17–19, respectively, under the control of the CCU 9. The cylinders 11–13 are rotated by the differentials 14–16, respectively. The output pulses produced from the second through fourth pulse generators PG2–PG4 since the home positions of the cylinders 11–13 have been detected by the sensors 23–25 are counted by the positioning controllers 17–19, respectively. The controllers 17–19 find the angular displacements of the rotating cylinders 11–13 from their home positions from the counted values of the output pulses from the pulse generators PG2–PG4, and inform the CCU 9 of the angular positions of the cylinders 11–13. The CCU 9 calculates the angular displacements of the cylinders 11–13 from their home positions, the angular displacements corresponding to the distance of the kicker 6 from its home position. The CCU 9 drives the differentials 14–16 via the positioning controllers 17–19 and the driver circuits 20–22 until the angular displacements of the cylinders 11–13 from their home positions agree with the calculated values. In this case, the CCU 9 can order the positioning controllers 17–19 to bring the cylinders 11–13 into angular positions corresponding to the distance of the kicker 6 from its home position. The positioning controllers 17–19 receive the output pulses from the sensors 23–25 and the output pulses from the second through third pulse generators PG2–PG4 and drive the differentials 14–16 in such a way that the angular displacements coincide with the values instructed by the CCU 9. Alternatively, the CCU 9 compares the distance of the kicker 6 from its home position with the angular displacements of the cylinders 11–13 from their home positions, and causes the positioning controllers 17–19 to drive the differentials 14–16 until the former distance corresponds to the angular displacements. When the displacements of the cylinders 11–13 from their home positions correspond to the distance of the kicker 6 from its home position, the CCU stops the differentials 14–16 from rotating the cylinders 11–13, respectively. Then, normal operation is carried out. At this time, the reciprocation of the kicker 6 is in phase with the rotation of the cylinders 11–13. The first printing unit 2, the second printing unit 3, and the creaser-and-slotter unit 4 processes the sheets S of corrugated paper, e.g., they print or form creasing lines at predetermined positions on the sheets.

As described thus far, in the novel apparatus determining the processing positions of the printer-slotter drives the differentials to place the various processing units connected to the feeding unit in position, corresponding to the arbitrary position assumed by the kicker immediately prior to the start of operation under the next orders. Therefore, it is not necessary to return the kicker to its home position, unlike in the prior art techniques. This makes it unnecessary for the feeding unit to make adjustments for determining the positions at which paper is processed. This can lead to a reduction in the time required for the adjustments. Also, the feeding unit is not required to be equipped with a device for returning the kicker to its home position. Furthermore, the processing positions of the processing units are determined so as to to correspond to the arbitrary position of the kicker, though the time taken to adjust the positions is shortened and the instrumentation is simplified. Hence, the accuracy at which the processing units are placed in position can be maintained high, which provides great convenience.

What is claimed is:

1. An apparatus for determining the positions at which a printer-slotter processes paper, the printer-slotter including a feeding unit having a kicker, a plurality of processing units seperably connected in tandem to the feeding unit, a differential for each said processing unit to permit the positions at which the processing units process the paper to be adjusted separately, the feeding unit acting to feed paper, and a single drive motor for driving said processing units, said motor being operatively coupled to said processing units via gear trains, said apparatus comprising:

a position detector for detecting the position of the kicker of the feeding unit; and a central control unit which reads the position of the kicker from the output signal from the position detector and controls the differentials in such a manner that the positions at which the processing units process the paper correspond to the position of the kicker.

2. The apparatus of claim 1, wherein said processing units include printing units and a creaser-and-slotter unit.

3. The apparatus of claim 1, wherein said differentials are connected with said processing units, respectively.

4. The apparatus of claim 1, further including position detectors for detecting the angular positions of rotating cylinders included in said processing units, and wherein said central control unit compares the position of the kicker with the angular positions of the cylinders of the processing units.

* * * * *